United States Patent [19]

Perecman

[11] Patent Number: 4,502,599

[45] Date of Patent: Mar. 5, 1985

[54] PACKAGE AND METHOD OF PACKAGING RESEALABLE PLASTIC BAGS

[75] Inventor: Jack L. Perecman, Golden Valley, Minn.

[73] Assignee: Minnesota Mining and Manufacturing Company, St. Paul, Minn.

[21] Appl. No.: 595,593

[22] Filed: Apr. 2, 1984

[51] Int. Cl.[3] ..... B65D 85/62; B65D 33/20

[52] U.S. Cl. ..... 206/554; 206/526

[58] Field of Search ..... 206/554, 526, 494

[56] References Cited

U.S. PATENT DOCUMENTS

| | | | |
|---|---|---|---|
| 443,851 | 12/1890 | Hicks | 206/494 |
| 3,070,280 | 12/1962 | Richmond . | |
| 3,079,066 | 2/1963 | Roop . | |
| 3,380,579 | 4/1968 | Pinto | 206/526 |
| 3,420,433 | 1/1969 | Bostwick | 229/80 |
| 3,669,254 | 6/1972 | Chrysanthis et al. | 206/526 |
| 3,915,302 | 10/1975 | Farrelly et al. | 206/526 |
| 4,276,982 | 7/1981 | Sibrava et al. | 206/439 |

*Primary Examiner*—William T. Dixson, Jr.

*Attorney, Agent, or Firm*—Donald M. Sell; James A. Smith; John C. Barnes

[57] ABSTRACT

A package of resealable polymeric bags is formed by stacking the bags formed with a flap having a strip of pressure-sensitive adhesive extending beyond the flap such that the sealing flap of each successive bag is the mounting means for that bag in the package, and each bag is positioned with the open side exposed on the top of the stack to afford easy insertion of an article in the bag, removal of the bag from the stack, a folding and sealing of the flap.

6 Claims, 6 Drawing Figures

PACKAGE AND METHOD OF PACKAGING RESEALABLE PLASTIC BAGS

BACKGROUND OF THE INVENTION

1. Field of the Invention

This invention relates to an improved package of sealable polymeric bags, and in one aspect, to a package which improves the useability of the bags and better access to the bags.

2. Description of the Prior Art

Polymeric bags are traditionally stored in a roll with each individual bag joined to the bottom or top of the next successive bag along a perforated heat-sealed line, or, the bags are formed individually and are folded and placed in a stack, stacked and rolled or folded and then placed in a bag or box. The bags may be individually drawn from the box through an opening formed by removing a perforate cover, but, the bags must be unfolded and the open end located to place the article in the bag. Most commonly, wire ties or zip-type fasteners are used to seal the bags or the flap on the bag is folded and sealed onto the bag.

This type of packaging for bags provides increased time and difficulty in getting a bag prepared to receive an article, and is time-consuming. Bags which are joined in a continuous roll by perforations at the heat seals forming one bag and separating that bag from the next can be drawn from the roll and placed over articles such as the use for dry cleaning coverings, but, these bags and the method of use are an exception and differ from bags having a pocket into which an article is to be placed prior to closing the bag.

An additional packaging system for a stack of bags is "wicketing" where a stack of bags are mounted on a support by a spindle or legs of a staple, permitting the bags to be individually removed from the stack.

The present invention and the method of placing the bags in a stack, and particularly when placed on a support card which permits the same to be disposed in a vertical orientation adjacent to a work area, provides an improved method of packaging the bags and a new package of bags formed with a resealable flap.

SUMMARY OF THE INVENTION

The present invention relates to an improved method of packaging adhesive sealable and/or resealable polymeric bags which are formed with an envelope having a front panel and a rear panel which are joined at three edges and provided with a strip of pressure sensitive adhesive for sealing the open side. The strip of adhesive is exposed when the bag is open at one face of the bag. The strip of pressure-sensitive adhesive may be defined by a tape which is adhered along one edge to the free edge of a flap and extends beyond the flap to expose a portion of the adhesive coated on the tape surface for use in sealing the flap to the bag and over the opening of the bag. These bags may be packaged with the bags disposed in a common orientation on a support card. The first bag is attached as by an adhesive strip to the support and then the bags are stacked with each bag having its adhesive strip exposed to support a second bag on the first bag, which bag in turn supports a third bag etc.

The strip of adhesive may also be provided by a length of tape adhered along one edge to the edge of the rear panel, by a strip of transfer adhesive or double coated tape adhered to a flap projecting above the rear panel or the length of tape attached to the free edge of the flap along one edge of the tape with the other edge folded upon itself to expose only the center strip of adhesive or a length of strip material is fastened along the other edge of the tape. In each embodiment sufficient adhesive is exposed to support the adjacent bag in the package. As the envelope pocket is opened and an article is placed in the bag, the bag is readily peeled from the stack and the bag is closed by folding the strip of adhesive over the opening and the strip is sealed to the front panel of the bag.

BRIEF DESCRIPTION OF THE DRAWINGS

The present invention will be further described with reference to the accompanying drawing wherein.

DESCRIPTION OF THE PREFERRED EMBODIMENTS

Figure 3:
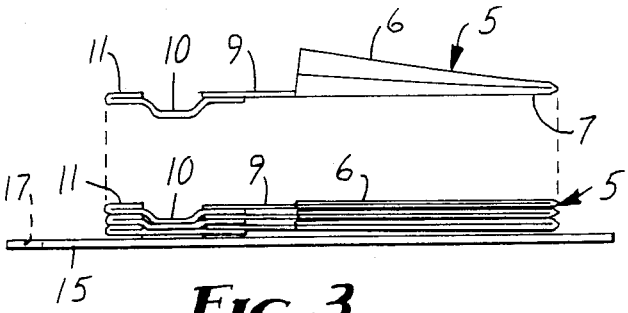
FIG. 3 is a side elevational view showing the package of the present invention with a plurality of bags in the package.

A bag 5 usable in the present invention comprises an envelope comprising a front panel 6 joined at its bottom edge and side edges to a rear panel 7 (FIG. 3), and which rear panel 7 has a flap 9 extending above the edge of the front panel defining thereby the envelope for receiving an article. The bag 5 can be sealed by a strip of pressure-sensitive adhesive provided on a length of tape 10, which tape is laminated along one edge to the free edge of the flap 9. The tape 10 has a length equal to that of the upper edge of the flap, and the opposite edge of the tape is folded, as at 11, with the adhesive coated surface of the tape folded toward the adhesive-coated surface of the tape to define a portion of the tape which would be free from adhesion to the bag and thus defining a release tab.

Figure 1:
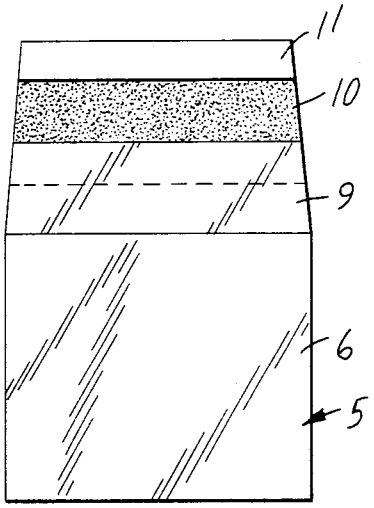
FIG. 1 is a front elevational view of a single polymeric bag formed with the strip of closable adhesive joined to the flap.
Figure 2:
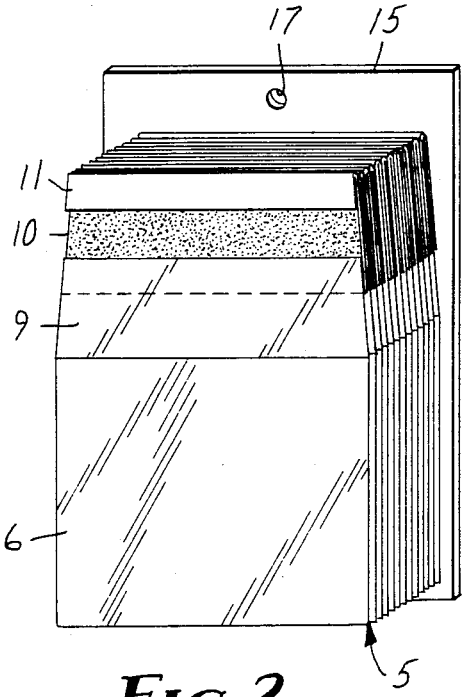
FIG. 2 is a perspective view of the package of bags formed in accordance with the present invention.

As illustrated in FIGS. 1 and 2, the flap tapers slightly from the upper edge of the bag, and the tape can be cut to continue the taper from the edge of the flap to the opposite edge of the tape where the tape has been folded upon itself.

In forming the package of the present invention, a plurality of bags 5 are formed from a web of polymeric film. The film is folded and then heat-sealed at predetermined intervals transversely of the web to form the envelope. A strip of tape is folded along one edge and is laminated along the opposite edge to the free edge of the film defining the flap of each bag which flap extends beyond the edge of the folded portion of the web. As the bags are cut and formed they are stacked front side up with the bags aligned and with a predetermined number of bags in each stack. The stack is then mounted on a card support member 15 which has a transverse strip of double coated pressure sensitive adhesive tape or transfer pressure sensitive adhesive 16 thereon to adhere the back panel of the bottom bag to the card.

The card is formed of a rigid material such as box board or the like and is preferably larger than the area of the bag. The exposed adhesive surface of each bag is pressed into contact with the surface of the next bag opposite the strip of exposed adhesive to form a bond between the bags as they are placed in the stack. This contact, as illustrated, between the exposed adhesive surface of one bag with the uncoated side of the tape opposite the adhesive of the next bag in the stack affords means for releasably securing the bags in the stack such that the stack of bags may be hung on edge at the work place as shown in FIG. 2 by a hole 17 in the support 15 to serve as a fastening member. Supported as illustrated, the package permits easy access to the envelope of the bag by grasping the free edge of the front flap and drawing it away from the rear flap to open the envelope. The article is placed into the open pocket and then the article and/or bag may be grasped by the envelope portion and peeled free from the next bag in the stack. The flap is placed over the open side, and the strip of adhesive is wiped into contact with the panel 6 to seal the opening.

This technique for packaging a supply of polymeric bags is particularly adaptable for use in assembly plants where objects are individually packaged in a bag.

Figure 4:
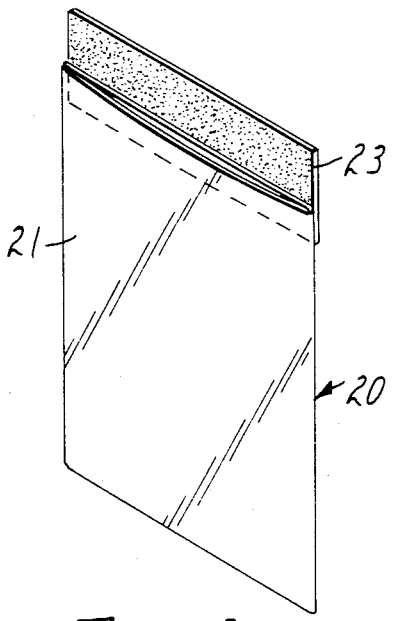
FIG. 4 is a perspective view of a second embodiment of the bag.

In FIG. 4 the bag 20 has a front panel 21 sealed about three edges to a rear panel. The panels are the same size and the seal is afforded by a length of pressure sensitive adhesive tape 23 laminated along one edge to the back panel. The tape 23 is disposed to expose a strip of the adhesive which can be folded over the bag opening and sealed to front panel 21. The exposed strip of adhesive is used to hold the bags in a stack with the lengths of tape aligned one above the other.

Figure 5:
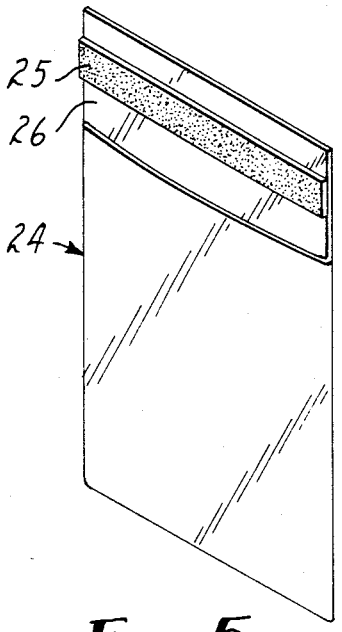
FIG. 5 is a perspective view of an additional embodiment of a bag usable in the present invention.

FIG. 5 discloses another bag 24 having a length of pressure sensitive adhesive transfer tape or a length of double coated tape 25 applied to the front surface of a flap 26. The tape 25 exposes a strip of pressure sensitive adhesive usable to seal the flap 26 over the bag opening and to the front panel of the bag. The same strip of adhesive permits the stacking of the bags.

Figure 6:
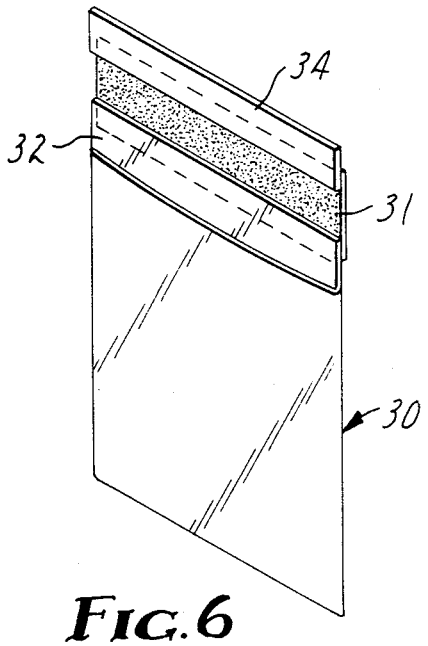
FIG. 6 is a perspective view of a further embodiment of a bag.

In FIG. 6 a bag 30 corresponding closely to the bag 5 is disclosed wherein a length of tape 31 is laminated along one edge to the free edge of the flap 32 and the opposite edge of the tape 31 is laminated to an edge of a ribbon 34 of paper, plastic or foil which has a width greater than the edge of the tape. The ribbon 34 forms a tab to permit a lifting of the tape to release the strip of adhesive from the front panel of the bag similar to the tab provided by the folded edge of the tape 10. The tape 31 has a strip of the pressure sensitive adhesive exposed when the envelope is open to afford a stacking of the bags in a package according to the present invention.

The bags are illustrated simply as envelopes but could be gusseted or fin sealed bags. Also, the size or shape of the bags can vary to fit the article to be packaged as straight pins do not require as long a bag as a loaf of French bread or a carpenters level. The length of the flap may vary from no flap at all to the flap of several inches to define an adequate closing flap for the bag and article packaged. A preferred size is a bag 5 inches (12.7 cm) wide by 7 inches (17.8 cm) long with a one inch (2.5 cm) flap.

The preferred form of tape for use with a polymeric bag which may be opened and closed a number of times is preferably an improved readily releasable pressure-sensitive adhesive which lacks the affinity for the polymeric bag so as not to cause a ripping, stretching, or tearing of the bag when it is desired to reopen the flap from the bag.

Examples of the polymeric films useful to make the bags include low density polyethylene which is 0.5 mil to 5 mils (0.012 mm to 0.127 mm) thick, preferrably 2 mils (0.5 mm), high density polyethylene 0.25 mil (0.06 mm) thick, polyester, nylon, laminates of these films, paper of 1 to 10 mils (0.025 to 0.25 mm), foil and foil laminates.

A preferred tape for resealing the bags after they have been sealed is "Scotch" brand number YR-8310 available from Minnesota Mining and Manufacturing Company of St. Paul, Minn. and a preferred non-resealable single coated tape is "Scotch" brand tape number 662 also available from Minnesota Mining and Manufacturing Company. A tape suitable for use as tape 25 is "Scotch" brand double coated tape number 665 or "Scotch" brand transfer tape number 969.

The present invention has been described with reference to a preferred embodiment, and it is to be appreciated that changes may be made without departing from the spirit or scope of the invention as defined by the appended claims.

I claim:

1. A package of polymeric bags each comprising an envelope and pressure-sensitive adhesive means adhered to the envelope for sealing the envelope, said adhesive means being placed on the opened envelope to expose a strip of pressure sensitive adhesive, comprising a plurality of said polymeric bags placed open in a stack with the strip of pressure-sensitive adhesive of each bag aligned, and with the strip of pressure-sensitive adhesive on one bag being in contact with the surface of the next bag in the stack opposite the exposed strip of pressure-sensitive adhesive of said next bag, and a support adhered to the back surface of the bottom bag of the stack.

2. A package as described in claim 1 wherein said support is a sheet of rigid material having means thereon for securing a bag to a surface of the support.

3. A package as described in claim 1 wherein the support is larger than the stack of bags, and has means for fastening the support member onto a vertical surface.

4. A package as described in claim 1 wherein said pressure-sensitive adhesive means for sealing the opening comprises a flap extending beyond one panel of the bag and a length of pressure-sensitive adhesive tape adhered along one edge to the free edge of the flap.

5. A package as described in claim 1 wherein said adhesive means comprises a length of pressure sensitive adhesive tape folded lengthwise upon itself along one edge with the opposite edge adhered to the envelope and exposing a strip of pressure sensitive adhesive for sealing the envelope.

6. A package as described in claim 4 wherein said length of tape is folded lengthwise upon itself along the edge opposite the edge adhered to said flap to form a release tab on the tape.

* * * * *